US005119645A

United States Patent [19]

Bisplinghoff et al.

[11] Patent Number: 5,119,645

[45] Date of Patent: Jun. 9, 1992

[54] WASHING MACHINE HAVING IMPROVED SUSPENSION AND MANUFACTURABILITY

[75] Inventors: Ross L. Bisplinghoff, Norfolk; William R. Quinn, Swampscott; Joseph C. Maiellano, Jr., Chelmsford; Robin C. Hossfield, Medway; Ronald A. Goyette, Ashby, all of Mass.; Patrick J. Radle, Ripon, Wis.

[73] Assignee: Raytheon Company, Lexington, Mass.

[21] Appl. No.: 633,927

[22] Filed: Dec. 26, 1990

[51] Int. Cl.[5] ..... D06F 37/24

[52] U.S. Cl. ..... 68/3.00 R; 68/23.3; 248/568; 248/638

[58] Field of Search ..... 68/3 R, 23.3, 23.1; 248/562, 568, 638

[56] References Cited

U.S. PATENT DOCUMENTS

| | | | |
|---|---|---|---|
| 1,886,888 | 11/1932 | Kirby | 68/23.3 |
| 1,905,912 | 4/1933 | Kirby | 68/23.3 |
| 2,300,421 | 11/1942 | Henderson | 68/23.3 X |
| 2,583,579 | 1/1952 | Lodge | 68/23.3 X |
| 2,585,107 | 2/1952 | Geldnof | 68/23.3 |
| 2,589,796 | 3/1952 | Geldhof | 68/23.3 |
| 2,648,401 | 8/1960 | Obermajer | 68/23.3 X |
| 3,729,960 | 5/1973 | Skinner | 68/23.3 |
| 3,958,433 | 5/1976 | Bochan | 68/23.3 |
| 4,174,622 | 11/1979 | Bunnell et al. . | |

*Primary Examiner*—Frankie L. Stinson

*Attorney, Agent, or Firm*—William R. Clark; Richard M. Sharkansky

[57] ABSTRACT

A washing machine includes a mid-level pivot and traverse suspension arrangement and a modular assembly. A support having a central aperture is spaced from the washing machine base by a plurality of upstanding legs. The modular assembly, including a drain tub, a drive shaft, and a transmission, is disposed on the support with the drive shaft and the transmission extending through the central aperture of the support. The modular assembly is a disengageable intact from the support with the transmission and the drive shaft passing through the central aperture of the support.

4 Claims, 5 Drawing Sheets

WASHING MACHINE HAVING IMPROVED SUSPENSION AND MANUFACTURABILITY

BACKGROUND OF THE INVENTION

This invention relates generally to automatic washing machines and more particularly to automatic washing machines designed for ease of manufacture.

As it is known in the art, an automatic washing machine generally includes a tub assembly disposed within a cabinet. The tub assembly includes a spin tub which is rotatably mounted in a drain tub A drive shaft is vertically disposed through the tub assembly and engages the spin tub for rotation thereof. The drive shaft is rotated by a motor coupled thereto and the rotation of the shaft is controlled by means of a transmission.

As it is also known in the art, automatic clothes washing machines are generally cycled through a sequence of operations in the processing of a wash load. For example, these operations may include a presoaking operation, a washing operation, a rinsing operation, and a spin drying operation.

Various factors are considered in the design of a support structure or suspension system for the washing machine tub assembly. Several of these factors influence the performance of the machine For example, the clothes may be unevenly distributed around the spin tub while it is rotated at relatively high speed during a spin drying operation. This phenomena is referred to as an out-of-balance condition and causes high centrifugal forces on the tub assembly at the circumferential location of the out-of-balance load. The high centrifugal forces in turn cause the tub assembly to pivot or tilt. The washing machine suspension should be designed to counterbalance the high centrifugal forces occurring as a result of a out-of-balance condition so that such forces are not transferred to the floor as vertical forces of large magnitude. Large vertical forces are undesirable since they tend to cause the washing machine to shake and, in aggravated circumstances, to physically move or "walk". Furthermore, in addition to performance considerations, the design of a washing machine suspension system should further take into account the ease with which the washing machine is manufactured.

One type of washing machine suspension is a mid-level pivot and traverse arrangement as described in U.S. Pat. No. 4,174,622 entitled "Automatic Washer Suspension System" The mid-level pivot and traverse suspension includes legs that elevate a support structure to a level approximately mid-way between the washing machine base and the top of the washing machine cabinet. A traversing member is disposed on the support structure and is designed to slide or traverse on such structure. The tub assembly, including the drain tub and spin tub mounted therein, is seated on the traversing member. With this arrangement, the pivoting or tilting forces are reduced by the addition of the extra degree of freedom in the horizontal direction. Lower pivoting forces result in lower reaction forces transferred to the floor, and thus, there is a reduction in the tendency of the washing machine to "walk".

More specifically, attached to and disposed underneath the drain tub are three inclined pads comprised of a relatively low friction material When the tub assembly is disposed over the mid-level support structure, the inclined pads attached to the tub assembly mate with complimentary inclined pads disposed on the traversing member. Thus, the tub assembly is free to pivot about the complimentary inclined mating surfaces; and also, the tub assembly can traverse with the traversing member. With this type of washing machine suspension, the spring forces required to hold the tub assembly upright are relatively small since the tub assembly is supported close to the bottom of the drain tub and thus the pivoting moment is relatively small. Due to the small spring forces required and also the horizontal degree of freedom provided by the traversing member, this suspension arrangement is capable of preventing "walking" with larger out-of-balance loads than a conventional base level, fixed pivot suspension.

However, the improved out-of-balance performance of the mid-level pivot and traverse suspension arrangement is achieved at the penalty of manufacture complexity, time, and cost. The ease with which the washing machine is assembled relates directly to the assembly time and is further related to the cost of the machine.

In particular, the assembly of the mid-level pivot and traverse arrangement is accomplished in several steps and thus, is both time consuming and costly. For example, a tub module, including the drain tub, spin tub, and drive shaft may be independently assembled and then positioned over the traversing member. However, once such a tub module is in place, the transmission must be attached to the drive shaft and the motor mounted. Also, a right angle drive member which provides coupling between the motor and the drive shaft is mounted after the tub module is seated on the traversing member. Mounting the motor, transmission, and drive member below the tub module may be awkward and difficult due to limited accessibility through the support legs. Manufacture time is also increased by the assembly of the traversing member due to the large quantity of parts that make up the member. Further, increased service and repair time may also be associated with the mid-level pivot and traverse suspension due to the multi-step disassembly required.

SUMMARY OF THE INVENTION

It is an object of the present invention to provide a washing machine that is relatively easy and quick to manufacture with a minimum of labor.

It is another object of the present invention to provide a washing machine requiring a minimum number of steps to assemble.

A further object of the present invention is to provide a washing machine that, in addition to being relatively easy and quick to manufacture, provides a suspension system with improved performance.

A still further object is to provide a washing machine having improved manufacturability and improved performance during an out-of-balance condition.

It is also an object of the present invention to provide a washing machine that is relatively easy and quick to disassemble and, therefore, to service and repair.

These and other objects of the invention are provided by a washing machine comprising a modular assembly including a drain tub, a drive shaft, and a transmission, with the assembly seated on a support, and the drive shaft and transmission extending through a central aperture in the support. The support is spaced from a base by a plurality of upstanding legs. The drive shaft engages the spin tub and the transmission is connected to the drive shaft. The modular assembly is disengageable intact from the support by passing the transmission and the drive shaft through the central aperture thereof.

In accordance with a further aspect of the present invention, a method of assembling the washing machine comprises the steps of connecting together a modular assembly including a drain tub, a drive shaft disposed through an aperture in said drain tub, and a transmission connected to the drive shaft. The method of assembling the washing machine further includes the step of providing a support for the modular assembly, with the support comprising an annular member spaced from a base by a plurality of upstanding legs. The modular assembly is seated intact on the support with the transmission and the drive shaft extending through the central aperture and the drain tub resting above the annular member.

With this arrangement, fabrication of the washing machine is simplified by requiring relatively few assembly steps. In particular, the tubs, drive shaft, transmission, and preferably also the motor, are pre-assembled as a modular unit. Due to the sizing of the central aperture in the support and the transmission, the module may be lowered intact onto the support The drive shaft and the transmission coupled thereto are sized to pass down through the central aperture of the support and the motor extends below the support but external to the central aperture. Once the modular assembly is seated on the support, a drive belt is coupled between the drive shaft and the motor and springs are coupled between the upstanding legs and the drain tub. Further, these fabrication steps may be reversed to provide a simplified method for disassembly of the washing machine in order to facilitate maintenance and repair.

BRIEF DESCRIPTION OF THE DRAWINGS

The foregoing features of this feature, as well as the invention itself, may be more fully understood from the following detailed description of the drawings in which.

DESCRIPTION OF THE PREFERRED EMBODIMENTS

Figure 1:
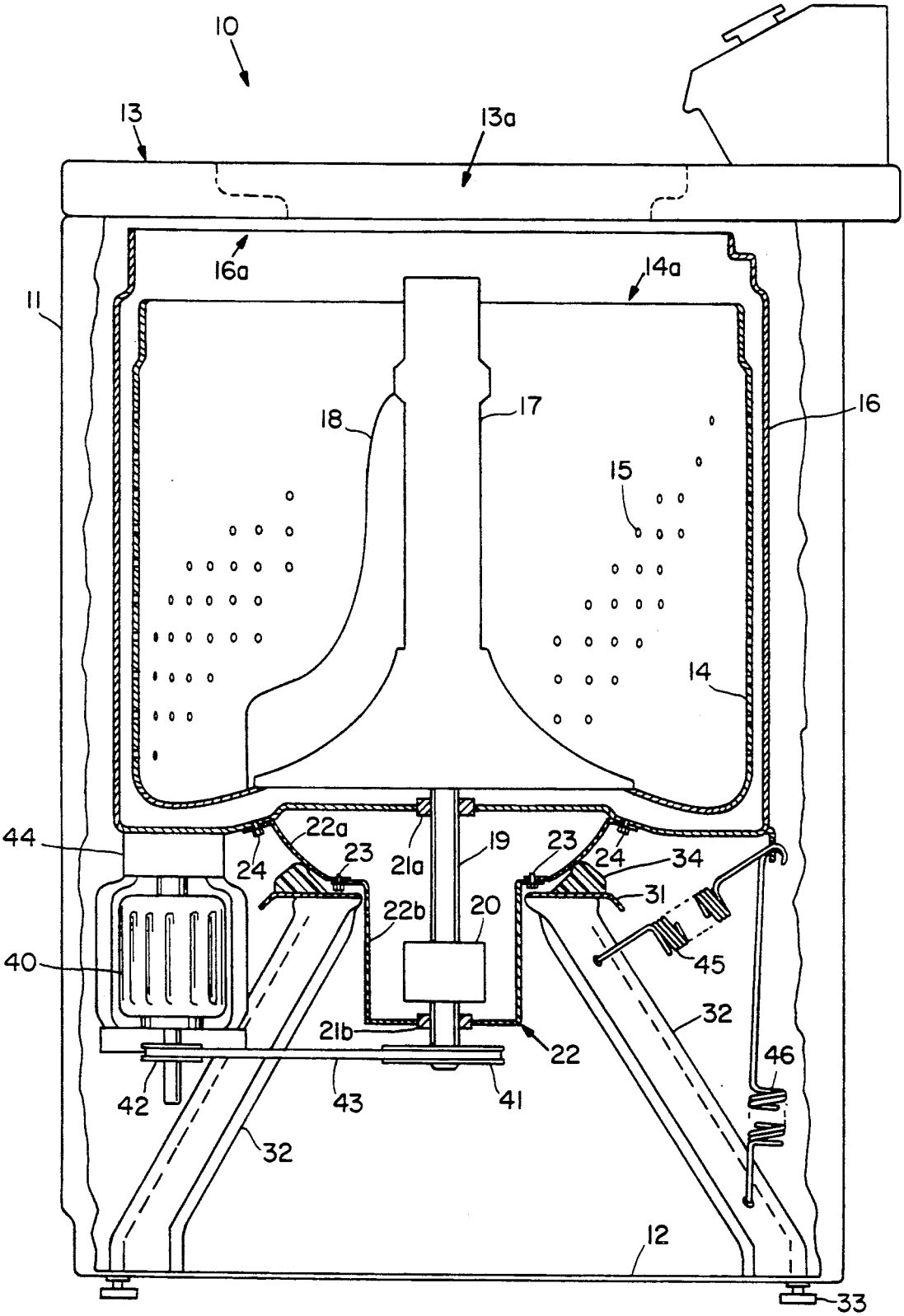
FIG. 1 is a side sectioned view of a washing machine in accordance with the present invention.

Referring now to FIG. 1, a washing machine 10 includes a cabinet 11 having a base 12 and a top cover 13. Top cover 13 has a lid opening 13*a* disposed therethrough and a lid (not shown) which maybe lowered over lid opening 13*a*. A wash load is deposited into the washing machine 10 and removed therefrom through the lid opening 13*a* in top surface 13. More particularly, the wash load is deposited into a spin tub 14. A wash load receiving opening 14*a* of spin tub 14 is aligned with lid opening 13*a* of top cover 13. Spin tub 14 is mounted within a drain tub 16 and has a plurality of perforations 15 disposed therethrough. Drain tub 16 has a top opening 16*a* which is aligned with the lid opening 13*a* of top cover 13 as well as with the wash load receiving opening 14*a* of spin tub 14 to permit clothes to be deposited into and removed from spin tub 14. Here, drain tub 16 and spin tub 14 are comprised of metal coated with a suitable material such as porcelain.

In operation, the washing machine is automatically cycled through various operations. For example, the operations may include a presoaking operation, a washing operation, a rinsing operation, and a spin drying operation. During the spin drying operation, the spin tub 14 is rotated at a relatively high rate of speed. Due to the centrifugal force exerted on the clothing by the rotation of the spin tub 14, the clothing is forced outward along the sides of the spin tub 14 and liquid is extracted therefrom. The liquid thus extracted is directed through the perforations 15 in the spin tub 14 and into the drain tub 16. A drain hole (not shown) in the bottom of drain tub 16 permits the liquid to exit drain tub 16 and flow through a conduit (not shown) to a suitable disposal location as is known in the art.

An agitator 17 is disposed within spin tub 14 and includes a plurality of fins, one of which 18 is shown here. In operation, and in particular during the washing operation, agitator 17 is rotatably moved in order to agitate the clothing in the spin tub 14 to facilitate the removal of dirt.

A drive shaft 19 extends up through an aperture in the bottom of drain tub 16. Drive shaft 19 includes two shafts, one coupled to the spin tub 14 and one coupled to the agitator 17 to provide independent rotation therewith, as is known in the art. The motor 40 provides the drive for drive shaft 19. In particular, a drive pulley 42 is coupled to a driven pulley 41 by a belt 43, and driven pulley 41 is coupled to a transmission 20 that is connected to drive shaft 19. Motor 40 is suspended below drain tub 16 by a bracket 44 which is attached to the bottom of drain tub 16 by suitable means.

Transmission 20 transforms the power and rotational speed of the motor 40 to a level appropriate for the rotation of the spin tub 14 and agitator 17. Conventionally, a transmission transforms the speed of the motor to a speed appropriate for rotation of drive shaft 19 and also changes the direction of the drive shaft rotation to provide bi-directional motion to the agitator 17. However, here a permanent split capacitor motor 40 is used in which the motor 40 is directly controlled to provide bi-directional motion. In other words, the transmission 20 is not required to change the direction of rotation of drive shaft 19 since that is done directly by the motor 40. One advantage of using the permanent split capacitor motor 40 over a conventional motor is the size of the transmission 20. In particular, the transmission 20 used with split capacitor motor 40 functions essentially as a speed reducer 20 only, and is substantially smaller in size and lower in cost than a transmission which additionally reverses the direction of the drive shaft 19 rotation.

A bearing 21*a* is disposed around drive shaft 19 where such shaft 19 enters drain tub 16 and is coupled to drain tub 16 in order to permit the free rotation of shaft 19. When the spin tub 14 rotates with an out-of-balance load, the pivoting or tilting force produces an opposing force on bearing 21*a*. The forces on bearing 21*a* are counteracted by the support provided thereto by stationary drain tub 16. Housing 22 is disposed over speed reducer 20, bearing 21*a*, and a portion of drive shaft 19, as shown. Drive shaft 19 extends through an aperture in the bottom of housing 22, where bearing 21*b* is located.

Housing 22 rigidly couples bearing 21*b* to drain tub 16, thereby locating drive shaft 19 perpendicular to the bottom surface of drain tub 16 and alleviating forces acting on bearing 21*b*.

Housing 22 includes two portions 22*a* and 22*b* securely attached together by suitable fastening means, here by bolts 23, and securely attached to drain tub 16 by bolts 24. Portion 22*a* of housing 22 has a spherical shape which provides a surface over which the drain tub 16 and spin tub 14 pivot, and thus may be referred to as pivot dome 22*a*. Pivot dome 22*a* is directed downwardly and is securely attached to drain tub 16 by suitable fastening means, here by bolts 24. Portion 22*b* of housing 22 extends from pivot dome 22*a* to bearing 21*b*, and may be referred to as bearing housing 22*b*. By providing rigid coupling between bearing 21*b* and the stationary drain tub 16, housing 22*b* improves the alignment of bearings 21*a* and 21*b* which in turn improves of alignment of the spin tub 14 with the drain tub 16.

Washing machine 10 further includes a support member 31 which is spaced from the base 12 by a plurality of upstanding legs 32. Here, support member 31 is approximately twelve inches above the base 12. Support member 31 has a central aperture. Here, support member 31 has an annular shape and may be referred to as a collar 31. The plurality of upstanding legs 32 are attached to collar 31 by any suitable means, and here by welding. Washing machine 10 here includes four upstanding legs 32 with each of such legs 32 being attached to a respective support pad 33 which elevates the base 12 of washing machine 10 off the floor.

A traversing member 34 is disposed over collar 31 and has a central aperture. Traversing member 34 slides horizontally on collar 31 and here, has an annular shape as will be discussed in more detail in conjunction with FIGS. 2–3A. The pivot dome 22*a* is seated on traversing member 34 such that the inner surface of traversing member 34 cooperates with the spherical surface of downwardly directed pivot dome 22*a*, as shown. More specifically, pivot dome 22*a* is seated on traversing member 34 such that the spherical surface of pivot dome 22*a* rests on a portion of the inner surface of traversing member 34, as shown. With this arrangement, drain tub 16 and spin tub 14 are free to pivot about the cooperating surfaces of pivot dome 22*a* and traversing member 34, and such tubs 14 and 16 are also free to move horizontally due to the sliding motion of traversing member 34 on collar 31.

Bearing housing 22*b* extends substantially through the central aperture of collar 31 and the central aperture of traversing member 34, as shown. Motor 40 extends below collar 31 and traversing member 34, but external to the central apertures of collar 31 and traversing member 34, respectively.

Washing machine 10 includes a plurality of centering springs 45 coupled between the bottom of drain tub 16 and the plurality of respective upstanding legs 32. Centering springs 45 maintain the drain tub 16 and spin tub 14 in a central position with respect to the plurality of upstanding legs 32. Also, a plurality of upright springs 46 are connected between the bottom of drain tub 16 and the plurality of respective upstanding legs 32. Upright springs 46 are coupled to upstanding legs 32 closer to the base 12 than are centering springs 45, as shown. Upright springs 46 function to hold drain tub 16 upright, and operate against any tendency of the tub 16 to tilt or pivot about traversing member 34. The force exerted on upright springs 46 is a function of the pivot angle of the drain tub 16, which in turn is a function of whether or not there is the added weight of water in drain tub 16.

Figure 1A:
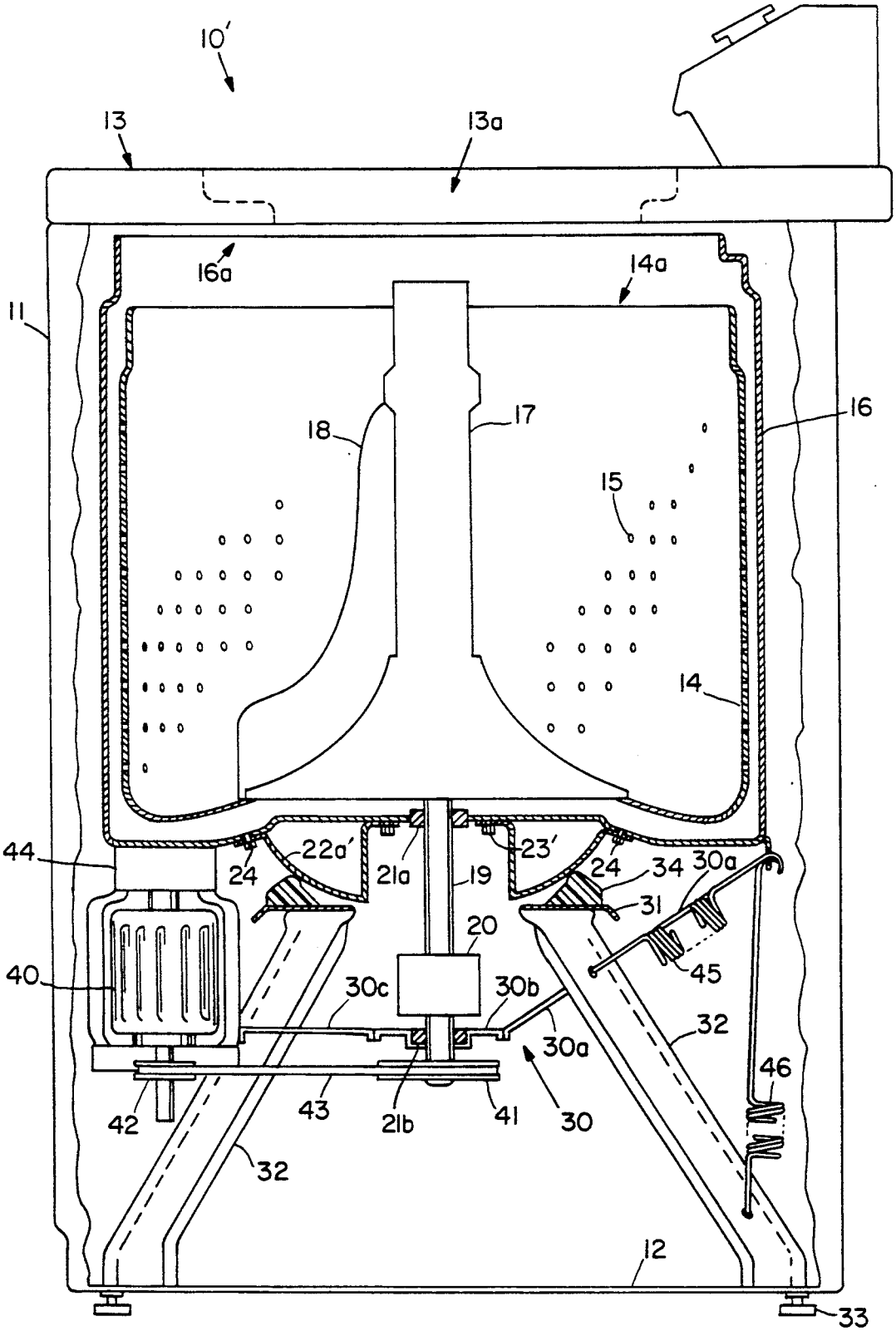
FIG. 1A is a side sectioned view of an alternate embodiment of a washing machine in accordance with the present invention.

Referring now to FIG. 1A, washing machine 10′ is an alternate embodiment of washing machine 10 of FIG. 1, and includes all of the same components except for housing 22. Here, as in FIG. 1, the pivot dome 22*a*′ is downwardly directed and has a spherical shape. Pivot dome 22*a*′ is attached to the bottom of drain tub 16 by bolts 24′. However, rather than being also attached to bearing housing 22*b* as in FIG. 1, pivot dome 22*a*′ is attached to the bottom of drain tub 16 adjacent to bearing 21*a* by bolts 23′, as shown. Once washing machine 10′ is assembled, pivot dome 22*a*′ rests on the inner surface of traversing member 34 as described with reference to FIG. 1.

Washing machine 10′ includes a strut 30 which has a first portion 30*b* attached to bearing 21*b*. A second portion 30*a* of strut 30 is securely attached to the bottom of drain tub 16 and the first strut portion 30*b*, by any suitable means such as bolts. A third portion 30*c* of strut 30 is attached to the motor 40 and to the first strut portion 30*b*, by any suitable means, as shown. In a manner similar to housing 22 of FIG. 1, strut 30 counteracts the forces exerted on bearing 21*b* by the pivoting motion of drain tub 16.

Figure 2:
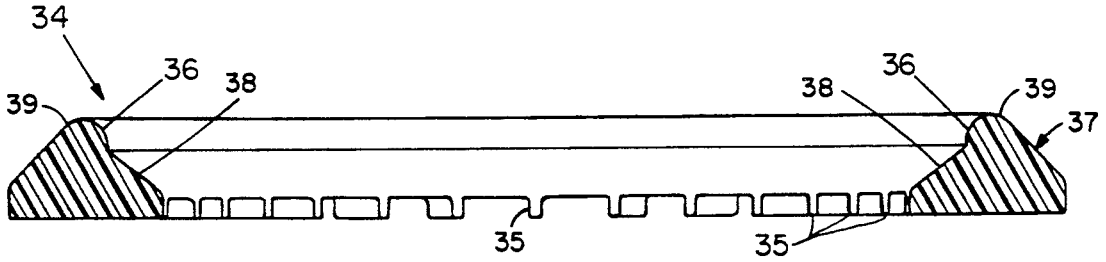
FIG. 2 is a cross sectional view of the traversing member in accordance with the washing machine suspension arrangement of the present invention.
Figure 3:
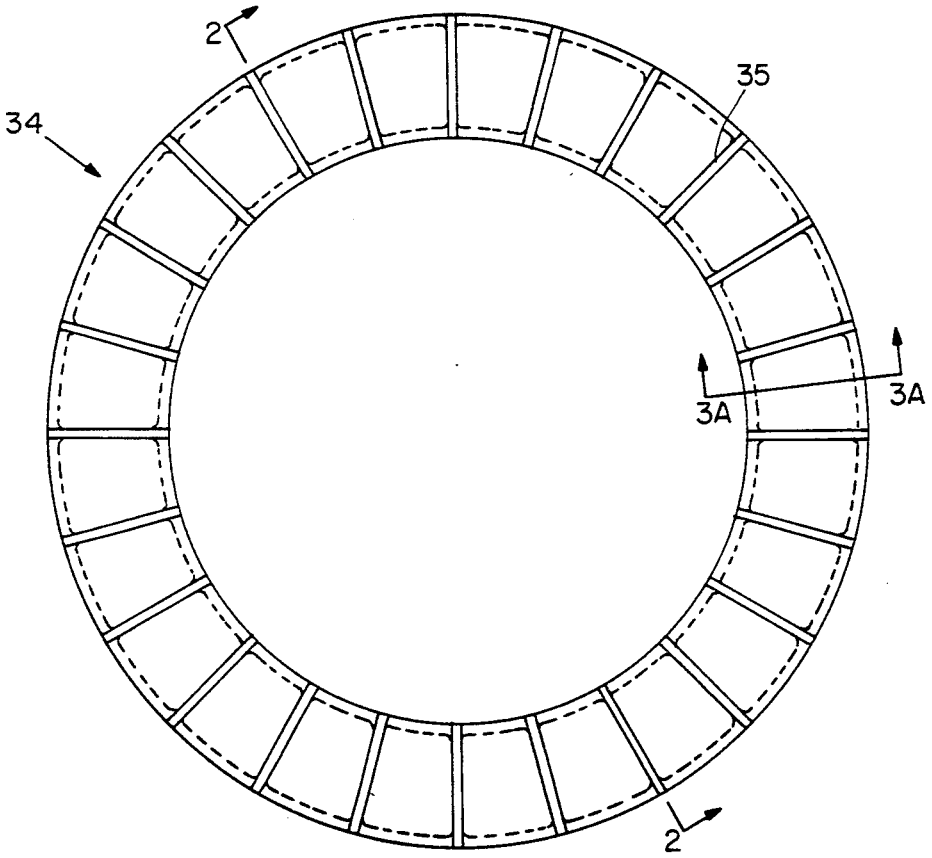
FIG. 3 is a bottom plan view of the traversing member of FIG. 2.
Figure 3A:
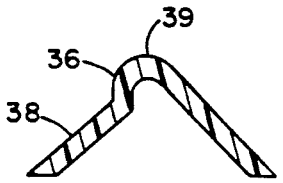
FIG. 3A is a cross-sectional view of the traversing member taken along line 3A—3A of FIG. 3.

Referring now to FIGS. 2 and 3, traversing member 34 is shown to have an annular or ring shape. Preferably, traversing member 34 is a unitary, injection molded part. A hollow top portion 37 of the member 34 has a rounded peak 39 and an inner surface 38 having a downward slope. The top portion 37 is supported by a plurality of relatively thin sliding contact portions 35 which contact collar 31 over which traversing member 34 is disposed. Here, there are twenty-four sliding contact portions 35 providing approximately 4.65 square inches of surface area which contacts collar 31. The thickness of sliding support portions 35 is, here, approximately 0.125 inches. The wall thickness of hollow top portion 37 of traversing member 34 is, here, approximately 0.125 inches. The molding of traversing member 34 is made easier by having the thickness of sliding support portions 35 be the same as the wall thickness of top portion 37. Furthermore, by making the top portion 37 hollow, the amount of material in the traversing member 34 is reduced and thus, the cost is also reduced.

Although traversing member 34 is, preferably, a unitary molded part, it may alternatively be a composite of the sliding contact portions 35 and the non-contacting portions 37 secured together by any suitable means such as mechanical fastening. Furthermore, the traversing member 34 may be modified to vary the amount of surface area contacting collar 31 as well as the distribution of such surface area.

The traversing member 34 is comprised of a material having a relatively low coefficient of friction. The low friction material permits traversing member 34 to slide relatively easily over collar 31 and to permit drain tub 16 disposed thereon to pivot with relative ease. Here, traversing member 34 is comprised of an acetal homopolymer sold under the product name of Delrin TL by Dupont of Wilmington, Del. The preferable material has a coefficient of friction of between approximately 0.05 and 0.25. When drain tub 16 is disposed over collar 31, or more particularly, when downwardly directed pivot dome 22*a* is seated on traversing member 34, the spherical surface of pivot dome 22*a* contacts a ring portion along the circumference of the inner surface of traversing member 34 centered at arrows 36 in FIG. 2.

The shape of traversing member 34, and in particular of the contact ring 36, is designed to provide a friction force which permits relatively unrestrained pivoting of the drain tub 16 about such contact ring 36 while not permitting such excessive pivoting motion as to require an unnecessarily large cabinet 11. Thus, one way in which the washing machine 10 of FIG. 1 provides improved performance during an out-of-balance condition is to provide a friction force between the pivot dome 22*a* and traversing member 34 corresponding to an optimized trade-off between pivoting ease and cabinet size. In particular, the static friction force provided on the traversing member 34 is equivalent to the normal force exerted thereon multiplied by the static coefficient of friction of the material of the traversing member 34. Here, the normal force is approximately 150 lbs. and the preferred static coefficient of friction is between approximately 0.05–0.25. Thus, the resulting static friction force is between approximately 7.5 lbs. to 37.5 lbs. Here, the cabinet is approximately 25.625 inches wide and 26.0 inches deep. Also, the lateral motion of traversing member 34 improves the out-of-balance performance of the washing machine 10 by providing an additional axis of freedom in which the drain tub 16 can move.

Another way in which the washing machine 10 of FIG. 1 provides improved out-of-balance performance, is by designing the various components of a tub assembly to provide a static center of mass disposed above collar 31. Specifically, here, there can be an out-of-balance load of approximately 5.0 lbs. without causing an undesirable "walking" effect. With a 5.0 lb. out-of-balance load, a reaction force with a vertical component of approximately $\pm 10$ lbs. is transferred to the floor by each support pad 33, in phase with the rotary motion of the out-of-balance tub.

Figure 4:
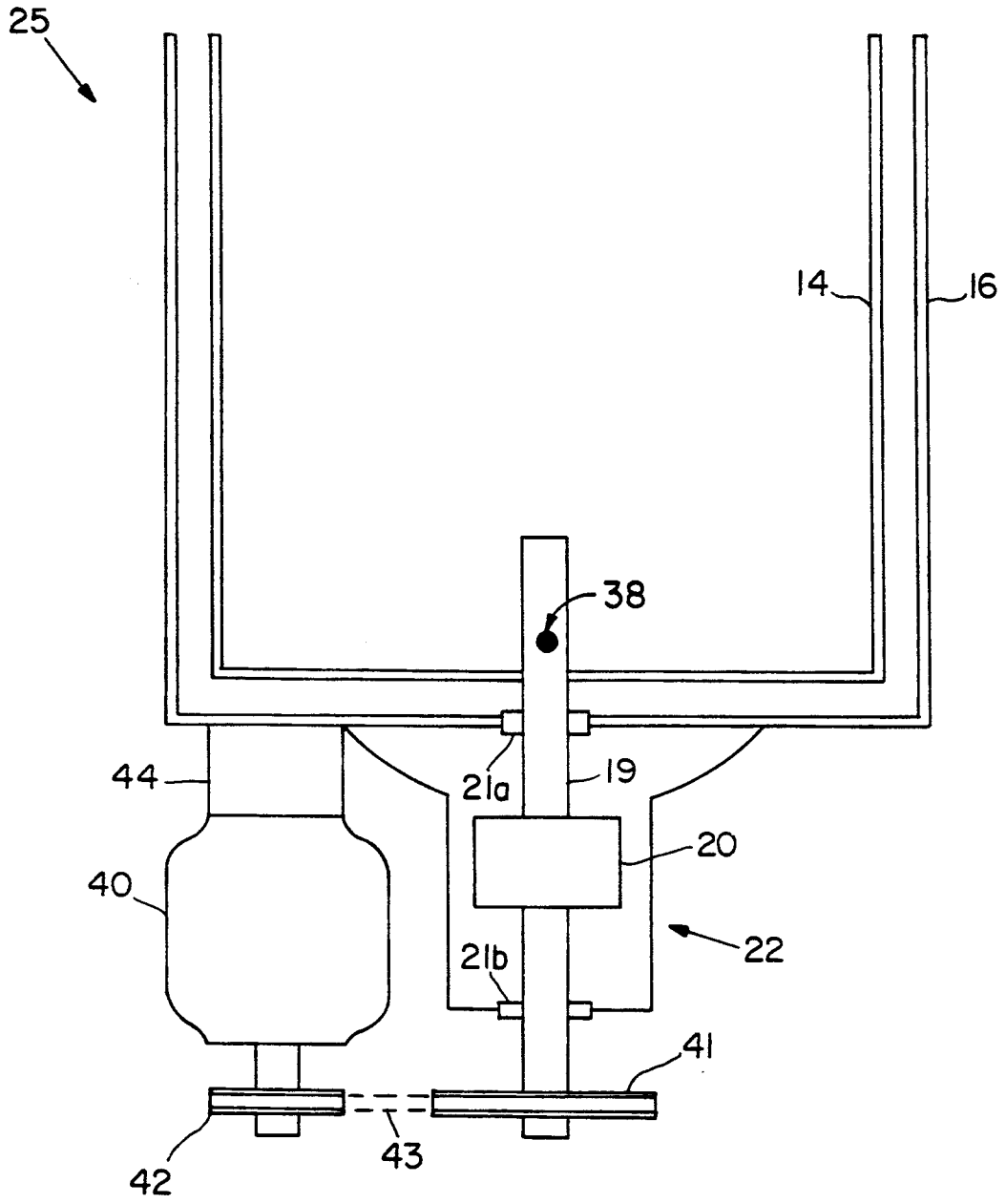
FIG. 4 is a simplified diagrammatical view of the washing machine of FIG. 1.

Referring now to FIG. 4, a tub assembly 25 is shown to include drain tub 16, spin tub 14, drive shaft 19, transmission 20, driven pulley 41, motor 40, drive pulley 42, bracket 44, and belt 43. The drain tub 16 has an approximate diameter of 22.0 inches, a height of 20.0 inches, and an approximate weight of 21 lbs. The spin tub 14 weighs approximately 17.5 lbs. with a diameter of approximately 20.0 inches and an approximate height of 16.0 inches. The motor 40 has an approximate weight of 9.0 lbs. and has an appearance diameter of 5.0 inches and a height of 5.5 inches. Speed reducer 20 weighs approximately 7.0 lbs. Housing 22 weighs approximately 2.5 lbs. and bearing housing 22*b* has an approximate diameter of 5.75 inches. The combination of drive pulley 42, driven pulley 43, drive belt 43, and drive shaft 19 weighs approximately 1.5 lbs. The approximate diameter of the drive pulley 42 and the driven pulley 41 are 2.0 inches and 5.0 inches respectively. Thus, tub assembly 25 has a total weight of approximately 58.5 lbs. The static center of mass 38 of tub assembly 25 is located approximately at the bottom of spin tub 14. More particularly, here, the static center of mass 38 is approximately 0.9 inches above the bottom of spin tub 14 and approximately mid-way between the collar 31 and the typical out-of-balance load which has been determined by statistical data to be located between approximately four to six inches above the bottom of the spin tub 14.

Various design choices contribute to the location of the static center of mass 38. Specifically, here, bracket 44 attaches motor 40 approximately 1.5 inches below drain tub 16. By attaching motor 40 close to tub 16, the static center of mass 38 is higher than it would be if the motor 40 were located closer to the base 12. Furthermore, the use of a relatively light speed reducer 20, as opposed to a conventional transmission, further raises the static center of mass 38. Although it is not shown here, water balance rings are used on some commercially available washing machines. If one is used on the washing machine 10, the static center of mass and the dynamic center of mass would be raised.

It should be noted that although the tub assembly 25 is here shown to include housing 22 in accordance with washing machine 10 of FIG. 1, strut 30 of washing machine 10' (FIG. 1A) has, approximately, the same weight as housing 22. Thus, the center of mass of the tub assembly of washing machine 10' is approximately the same as center of mass 38.

The weight of water and clothes in the tub assembly 25 during operation provides an initial dynamic center of mass which may be located at approximately the same vertical level as the static center of mass 38 or higher depending on such weight. The tendency of the tub assembly 25 to pivot, and thus, of the machine to "walk," is generally at a maximum magnitude during an out-of-balance load condition and, specifically, when the spin tub 14 is rotated at maximum speed. Furthermore, when the spin tub 14 is rotated at maximum speed, most of the water has typically been drained from the tub assembly 25. Thus, during this operating condition, the dynamic center of mass will be located relatively close to the static center of mass 38.

By providing the dynamic center of mass relatively close to the typical out-of-balance location, the large forces that would otherwise be transferred to the floor are reduced. The magnitude of the pivoting force is, among other things, a function of the distance between the dynamic center of mass of the tub assembly and the location of the out-of-balance load. Thus, when the out-of-balance load and the dynamic center of mass are disposed at the same axial position, the pivoting force is essentially zero and the motion of the tub assembly 25 is more one of sliding or traversing rather than pivoting.

Summarizing, the tub assembly 25 can either pivot on traversing member 34 or traverse with traversing member 34 in response to the forces caused by an out-of-balance load during a spin operation. In other words, with the heretofore described suspension, there are two possible reactive motions to an out-of-balance load; they are pivoting and traversing. The "walking" forces on washing machine 10 have been found to be primarily associated with the pivoting motion Thus, if the reactive motion is primarily traversing rather than pivoting at the maximum spin speed, the tendency to "walk" is greatly reduced. When the dynamic center of mass of a tub assembly is much lower than the unbalanced load, the pivoting action is significant, resulting in a strong tendency for the washing machine to "walk". However, tub assembly 25 is here designed so that the dynamic center of mass is relatively high. That is, the dynamic center of mass is closer to the vertical level of a typical out-of-balance load, thereby providing more traversing motion and less pivoting. Thus, there is less tendency for the washing machine to "walk". In fact, if the dynamic center of mass is vertically aligned with the unbalanced load, the pivoting moment arm is zero so theoretically, all the motion is traversing while none is pivoting. Although the dynamic center of mass is the key operative factor, it is a function of such variables as the wash water which is draining during the spinning operation. As a result, it is generally more convenient to analyze the static center of mass which is approximately the same as the dynamic center of mass when maximum spinning speed is reached and most of the water has drained.

Figure 5:
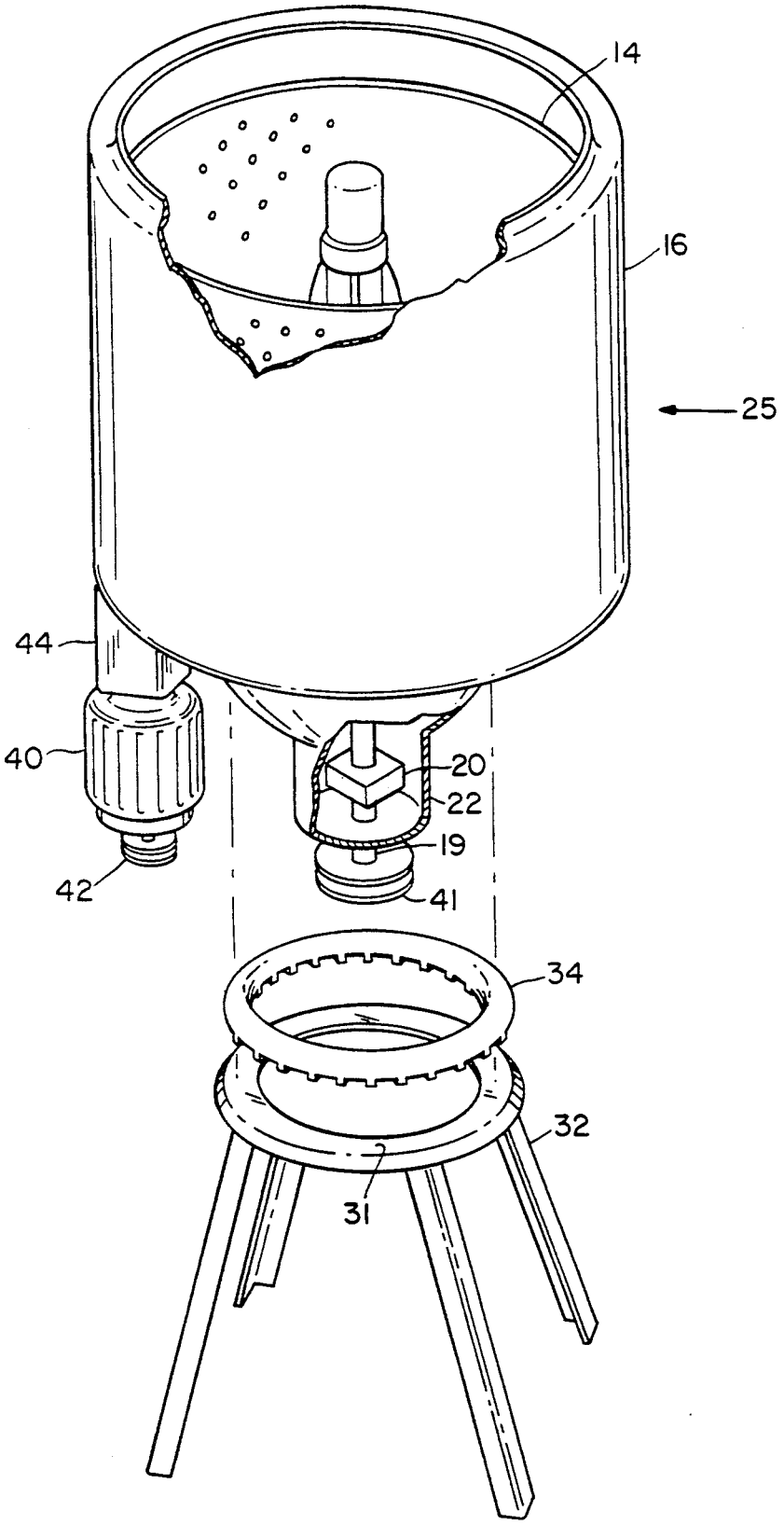
FIG. 5 is a simplified diagrammatical exploded isometric view of the washing machine of FIG. 1.

Referring now to FIG. 5, an exploded view of washing machine 10 is shown for clarity in discussing the assembly process for machine 10. Tub assembly 25, including drain tub 16, spin tub 14, drive shaft 19, transmission 20, housing 22, motor 40, bracket 44, bearings 21*a* and 21*b*, and pulleys 41 and 42, is assembled to provide a module 25. The assembly of module 25 may be divided into sub-assembly operations. For example, it may be desirable to separately assemble the transmission 20 with bearing 21*a* and 21*b* and then connect this sub-assembly to the remaining components of tub assembly 25. During assembly, the components of modular assembly 25 are secured together as generally described above, in conjunction with FIG. 1. Upstanding legs 32 are attached to collar 31 by suitable means, here by welding. The modular assembly 25 is lowered over collar 31 to a seated position. More particularly, traversing member 34, described in conjunction with FIGS. 1–3A, is disposed over collar 31 and modular assembly 25 is then lowered thereon. Downwardly directed pivot dome 22*a* rests on and cooperates with the inner surface of traversing member 34. When modular assembly 25 is in seated position on traversing member 34, bearing housing 22*b*, drive shaft 19, speed reducer 20, and driven pulley 41 extend through the central aperture of traversing member 34 and below collar 31 as shown in FIG. 1. In particular, the central aperture of collar 31 has a diameter of 7.75 inches and the central aperture of traversing member 34 has a 7.75 inch diameter. As previously mentioned, the approximate diameters of the speed reducer 20, driven pulley 41 and bearing housing 22*b* are 5.0 inches, 5.0 inches, and 5.0 inches, respectively. Thus, when the modular assembly 25 is lowered down onto traversing member 34, the bearing housing 22*b*, speed reducer 22, and driven pulley 41 are able to fit through the central apertures of collar 31 and traversing member 34. When modular assembly 25 is disposed on traversing member 34, motor 40 also extends below support member 31, but external to the respective central apertures of collar 31 and traversing member 34 (FIG. 1).

Once modular assembly 25 is placed in seated position on traversing member 34, the belt 43 is attached around drive pulley 42 and driven pulley 41. Further, centering springs 45 and upright springs 46 are secured between drain tub 16 and the respective one of the plurality of upstanding legs 32, one set of such springs 45 and 46 being shown in FIG. 1.

As mentioned above, due to the relatively narrow profile of transmission 20, bearing housing 22, and driven pulley 43, these components are able to fit through the respective central apertures of collar 31 and traversing member 34, thereby reducing the number of steps in the assembly of the washing machine 10. In other words, if the transmission 20 for example were too large to fit through the central aperture of collar 31 and traversing member 34, such transmission 20 would have to be attached to the drive shaft 19 after the tubs 14 and 16 and drive shaft 19 were lowered onto traversing member 34. Such an operation would tend to be awkward and difficult due to the limited access to the drive shaft 19 through the plurality of upstanding legs 32. Here, however, module 25 is assembled separately and then merely lowered down intact onto traversing member 34 which is supported on collar 31.

When servicing of the washing machine 10 is required, necessitating the removal of modular assembly 25, the assembly steps are reversed. Thus, once centering springs 45 and upright springs 46 as well as belt 43 are removed, modular assembly 25 may be lifted up from collar 31 and traversing member 34 intact. Thus, with this arrangement, which permits module 25 to be assembled as a unit and then placed over traversing member 34 and collar 31, both the assembly and serviceability of washing machine 10 are enhanced by permitting such modular assembly 25 to be disposed over and removed from collar 31 intact, or as a single module 25.

It should be noted that in the assembly of washing machine 10' of FIG. 1A, strut portions 30*a* and 30*c* would be attached after the modular assembly 25 was lowered onto traversing member 34. However, the diameter of strut portion 30*b* is approximately the same as that of bearing housing 22*b* and thus, such strut portion 30*b* extends below collar 31 through the central aperture thereof. In other words, strut portion 30*b* is part of the module that is pre-assembled prior to its placement over traversing member 34. However, strut portions 30*a* and 30*c* are attached to the assembly after it is disposed over traversing member 34.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

We claim:

1. A washing machine comprising:

a base;

a collar having a central aperture, said collar being spaced from said base by a plurality of upstanding legs;

a modular assembly comprising:

(a) a drain tub;

(b) a drive shaft disposed through an aperture in said drain tub; and (c) a transmission coupled to said drive shaft;

suspension means for supporting said modular assembly on said collar, said suspension means comprising:

(a) traversing means seated and horizontally moveable on said collar for permitting horizontal movement of said modular assembly; and (b) means coupled to said drain tub and cooperating with said traversing means for permitting pivoting movement of said modulator assembly with respect to said collar; and said modular assembly being supported on said suspension means with said drive shaft extending through said central aperture of said collar and said transmission being suspended from said drive shaft below said collar, said modular assembly being disengageable intact from said collar with said transmission passing through said central aperture of said collar.

2. The washing machine recited in claim 1 further comprising a motor attached to said drain tub.

3. The washing machine recited in claim 1 wherein said transmission comprises a speed reducing module.

4. The washing machine recited in claim 1 wherein the support has an annular shape.

* * * * *